United States Patent [19]

Adams et al.

[11] 4,312,767

[45] Jan. 26, 1982

[54] LUBRICANT COMPOSITION CONTAINING FRICTION-MODIFYING AGENT AND ANTIWEAR AGENT

[75] Inventors: John H. Adams, San Rafael; Donald D. Dexter, Concord, both of Calif.

[73] Assignee: Chevron Research Company, San Francisco, Calif.

[21] Appl. No.: 8,913

[22] Filed: Feb. 2, 1979

[51] Int. Cl.[3] ..... C10M 1/10

[52] U.S. Cl. ..... 252/25; 252/49.8; 252/49.9; 252/75

[58] Field of Search ..... 252/25, 49.8, 75, 49.9

[56] References Cited

U.S. PATENT DOCUMENTS 3,652,410 3/1972 Hollinghurst et al. ..... 252/32.7 E 3,997,454 12/1976 Adams ..... 252/25

*Primary Examiner*—Curtis R. Davis

*Attorney, Agent, or Firm*—D. A. Newell; J. J. DeYoung

[57] ABSTRACT

Disclosed is an improved lubricating oil composition containing a friction-modifying agent and an alkali metal borate antiwear agent.

6 Claims, No Drawings

LUBRICANT COMPOSITION CONTAINING FRICTION-MODIFYING AGENT AND ANTIWEAR AGENT

FIELD OF THE INVENTION

This invention relates to lubricating oil compositions, particularly to lubricating oil compositions useful as functional fluids in systems requiring coupling, hydraulic fluids, and/or lubrication of relatively moving parts. More particularly, this invention relates to lubricating oil compositions useful as hydraulic fluids and as lubricants in transmission and differentials of heavy machinery, particularly high-power-output tractors.

BACKGROUND OF THE INVENTION

The trend today in the field of heavy machinery is toward increasing power and introducing devices which not only make the machinery more efficient but reduce operator fatigue. Some of these labor-saving devices include double-acting hydraulic systems, power steering and power brakes. Power brakes can either be of the drum type or disc type. The disc brake is favored, since it offers more braking capacity than the drum-type brake. The wet type of disc brake is preferred because it can be installed inside the differential housing where it is isolated from the dirt and grime of day-to-day operations.

The wet-type brake is in contact with the lubricating oil. A special oil is required which lubricates all of the relatively moving parts such as the differential gears, transmission gears, etc. At the same time, the lubricating oil must not prevent proper braking action. Furthermore, it must not promote brake chatter. Chatter is caused by slip-stick operation of the brakes when they are in contact with certain types of fluids. Friction-modifying agents, such as dioleylhydrogen phosphite, have been added to tractor hydraulic fluids to reduce chatter. However, lubricants containing such agents have tended to suffer from very high wear rates, particularly at high temperature.

Alkali metal borates are well known in the art and have been used in many lubricants, particularly for their extreme-pressure properties. See, for example, U.S. Pat. Nos. 3,853,772, 3,907,691 and 3,997,454.

SUMMARY OF THE INVENTION

It has now been found that a lubricating oil composition containing a friction-modifying agent and an alkali metal borate antiwear agent exhibits good antichatter characteristics and surprisingly superior antiwear characteristics.

DETAILED DESCRIPTION OF THE INVENTION

The lubricating oil composition and additive concentrate of the present invention contain an effective amount of a friction-modifying agent and an effective amount of an alkali metal borate antiwear agent. The concentration of the friction-modifying agent will generally range from 0.05 to 10, preferably 0.2 to 5, weight percent of the final lubricating oil composition, while the concentration of the antiwear agent will range from 0.1 to 20 weight percent, preferably 0.5 to 5 weight percent. In a concentrate additive form, the concentration of the friction-modifying agent will range from 0.25 to 99, preferably 1.0 to 50, weight percent of the concentrate, while the concentration of the antiwear agent will range from 1.0 to 99, preferably 5.0 to 50, weight percent. The friction-modifying agents reduce the coefficient of friction and are well known in the art. Representative friction-modifying agents are dioleylhydrogen phosphite, pentaerythritol mono-oleate, oleic acid, sperm oil, both natural and synthetic (unsulfurized and sulfurized), alkyl imidazolines, fatty amines and amides, hydrocarbyl phosphonates, glycerol oleates and sorbitan oleates. Particularly preferred are dioleylhydrogen phosphite and pentaerythritol mono-oleate.

Pentaerythritol mono-oleate as it is commercially available is usually a mixture of mono-, di-, tri- and tetraoleates of pentaerythritol. Some oleic acid may also be present. As used herein, the term "pentaerythritol mono-oleate" is intended to include both pure pentaerythritol mono-oleate and mixtures of pentaerythritol mono-, di-, tri- and tetraoleate.

The alkali metal borate antiwear agents are well known in the art and are available commercially. Representative patents disclosing the methods of manufacture include U.S. Pat. Nos. 3,313,727, 3,819,521, 3,853,772, 3,907,691, 3,997,454 and 4,089,790, the entire disclosures of which are incorporated herein by reference. Preferred are the hydrated potassium borates, particularly the hydrated potassium triborate microparticles having a boron-to-potassium ratio of about 2.5 to 4.5. The hydrated borate particles have a mean particle size of less than 1 micron.

The lubricating oil to which the friction-modifying agent and antiwear agent are added can be any hydrocarbon-based lubricating oil. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, dispersants, rust inhibitors, foam inhibitors, corrosion inhibitors, other antiwear agents, and a variety of other well-known additives.

Measuring the milligrams of gear weight loss in a standardized test, reductions in wear of up to 2500% have been observed using the compositions of the present invention, as compared to compositions not containing the antiwear agent of the present invention.

What is claimed is:

1. A lubricating oil composition comprising a major amount of an oil of lubricating viscosity and 0.05 to 10 weight percent of a friction-modifying agent selected from dioleylhydrogen phosphite, pentaerythritol mono-oleate, synthetic sulfurized sperm oil, fatty amides containing 12 to 18 carbon atoms, and glycerol mono-oleate, and 0.1 to 20 weight percent of an alkali metal borate antiwear agent.

2. The composition of claim 1 wherein said antiwear agent is hydrated potassium borate.

3. The composition of claim 2 wherein said composition contains 0.05 to 10 weight percent of said friction-modifying agent and 0.2 to 5 weight percent of said alkali metal borate antiwear agent.

4. A lubricating oil additive concentrate comprising 0.25 to 90 weight percent of a friction-modifying agent selected from dioleylhydrogen phosphite, pentaerythritol mono-oleate, synthetic sulfurized sperm oil, fatty amides containing 12 to 18 carbon atoms, and glycerol mono-oleate, and 1.0 to 99 weight percent of an alkali metal borate antiwear agent.

5. A lubricating oil composition comprising a major amount of an oil of lubricating viscosity and 0.05 to 10 weight percent of dioleylhydrogen phosphite and 0.1 to 20 weight percent of an alkali metal borate antiwear agent.

6. A lubricating oil additive concentrate comprising 0.25 to 90 weight percent of dioleylhydrogen phosphite and 1.0 to 99 weight percent of an alkali metal borate antiwear agent.

* * * * *